US005546913A

United States Patent [19]

Aoki

[11] Patent Number: 5,546,913

[45] Date of Patent: Aug. 20, 1996

[54] EVAPORATIVE FUEL DISCHARGE-PREVENTING DEVICE FOR ENGINE

[75] Inventor: Masahiro Aoki, Shizuoka-ken, Japan

[73] Assignee: Suzuki Motor Corporation, Shizuoka-ken, Japan

[21] Appl. No.: 442,476

[22] Filed: May 16, 1995

[30] Foreign Application Priority Data

Aug. 10, 1994 [JP] Japan ..... 6-209089

[51] Int. Cl.[6] ..... F02M 33/02

[52] U.S. Cl. ..... 123/520; 123/516

[58] Field of Search ..... 123/520, 521, 123/516, 518, 519, 198 D

[56] References Cited

U.S. PATENT DOCUMENTS

| | | | |
|---|---|---|---|
| 4,070,828 | 1/1978 | Barres | 123/521 |
| 5,080,078 | 1/1992 | Hamburg | 123/521 |
| 5,353,770 | 10/1994 | Osanai et al. . | |
| 5,437,257 | 8/1995 | Giacomazzi | 123/520 |
| 5,443,051 | 8/1995 | Otsuka | 123/520 |

FOREIGN PATENT DOCUMENTS

| | | | |
|---|---|---|---|
| 0052663 | 3/1982 | Japan | 123/520 |
| 0226553 | 10/1986 | Japan | 123/520 |
| 2-144657 | 12/1990 | Japan . | |
| 5-332205 | 12/1993 | Japan . | |

*Primary Examiner*—Carl S. Miller

*Attorney, Agent, or Firm*—Flynn, Thiel, Boutell & Tanis, P.C.

[57] ABSTRACT

An evaporative fuel discharge-preventing device for an engine which comprises a surge tank for leveling out fluctuations in the amount of evaporated fuel so as to provide a stabilized engine rotational speed, and to prevent the impairment of drivability. The surge tank has outlet and inlet side pipes arranged at a height position to avoid storing the evaporated fuel in a liquid state within the surge tank. The surge tank, having a predetermined volumetric capacity, is disposed midway of an air communication passage between an intake manifold and a purge valve, and is located at a height position greater than the intake manifold.

1 Claim, 4 Drawing Sheets

EVAPORATIVE FUEL DISCHARGE-PREVENTING DEVICE FOR ENGINE

FIELD OF THE INVENTION

This invention relates to an evaporative fuel discharge-preventing device for an engine and, more particularly, to an improved evaporative fuel discharge-preventing device which has a surge tank disposed midway of an air communication passage between an intake manifold and a purge valve so as to level out fluctuations in the amount of evaporative fuel to be admitted into the engine when the evaporative fuel is supplied from a canister to an air intake passage, whereby engine rotational speed is stabilized, which avoids detracting from drivability.

BACKGROUND OF THE INVENTION

In vehicles, evaporative fuel which leaks into the air from a fuel tank, a carburetor float chamber, etc., is described as one of causes of air pollution because of the large content of hydrocarbons (HC). The evaporative fuel also contributes to fuel loss. In view of the above, various techniques are known as a prevention thereagainst, and there is available an evaporative fuel controller representative of one such technique. In this controller, evaporated fuel from the fuel tank is absorbed by a canister which contains an absorbent such as activated carbon. When an engine is run, the absorbed fuel is released (purged) from the canister so as to be supplied to the engine.

One example of the above-described evaporative fuel discharge-preventing device for an engine is disclosed by published Japanese Patent Application Laid-Out No. 5-332205. According to the evaporative fuel-treating device taught in the aforesaid publication, a plurality of purge control valves are arranged in a side-by-side array in a purge passage which interconnects a canister and an air intake passage of an internal combustion engine on a downstream side of a throttle valve. While effecting control of a purge amount, the plurality of purge control valves causes evaporated fuel stored in a canister to be purged into the air intake passage in order to treat the fuel therein. A first valve control means performs duty control such as to open and close at least one of the purge control valves within a fixed duty cycle. A second valve control means provides control such as to open and close the other purge control valves on a duty cyclic basis. This construction holds or controls pulsation, and prevents vapor from flowing into a particular cylinder which would otherwise disturb the air-fuel ratio.

Another example is disclosed by published Japanese Utility Model Application Laid-Out No. 2-144657. According to a casing device for an engine taught in the above publication, the engine has a cam pulley connected to a forward end of a cam shaft so as to transmit a revolving force from a crankshaft via a belt which is trained around the cam pulley. A belt cover for covering the cam pulley and the belt is mounted on a front wall of a cylinder head of the engine. A transversely extending-through-gap is formed between the preceding front wall and a back wall of the belt cover. The gap has piping provided therethrough for distributing the fuel and the like.

In conventional evaporative fuel discharge-preventing devices for engines, the evaporative fuel generated in the fuel tank is temporarily absorbed by the canister; the absorbed, evaporative fuel is liberated (purged) from the canister during engine operation or vehicle traveling. The evaporative fuel is thereby supplied to the engine, together with fresh ambient air. At this time, negative pressure in an air intake pipe draws the evaporative fuel and outside air, i.e., ambient air.

However, an increase in size of the canister increases the amount of the evaporated fuel which is supplied to the engine.

As a result, the increased amount of the evaporated fuel to be supplied to the engine involves a disturbance of engine air-fuel ratio control. This causes an inconvenience, which is disadvantageous in view of practical use, in that engine rotational speed is unbalanced, with concomitant aggravation of drivability.

In order to obviate the above-mentioned inconveniences, the present invention provides an evaporative fuel discharge-preventing device for an engine having a canister provided midway along an air communication passage which intercommunicates the inside of a fuel tank and an air intake passage of an engine intake manifold, and a purge valve provided midway of the air communication passage between the canister and the intake manifold, in which the canister absorbingly retains evaporated fuel during stopping of the engine, the evaporated fuel being generated in the fuel tank, but releases the absorbingly retained fuel from the canister during operation of the engine by fresh air being introduced into the canister, whereby the evaporated fuel is supplied to the air intake passage, the improvement comprising a surge tank of a predetermined volumetric capacity being disposed midway of the air communication passage between the intake manifold and the purge valve, which tank is located at a position greater in height than the intake manifold.

Furthermore, the present invention provides an evaporative fuel discharge-preventing device, as aforesaid, wherein the surge tank has an outlet side pipe positioned at a lower portion thereof and an inlet side pipe located at a position above the outlet side pipe.

According to the present invention having the above structure, fluctuations in the amount of the evaporated fuel are made even by the surge tank which is placed midway along the air communication passage between the intake manifold and the purge valve. Consequently, a stabilized engine rotational speed is provided, which prevents degradation in drivability.

Furthermore, the surge tank has the outlet side pipe provided at a lower portion thereof and the inlet side pipe situated at a position above the outlet side pipe. Such a height position, at which the outlet and inlet side pipes are arranged, provides a smooth flow of coagulated evaporative fuel through the inside of the surge tank. This feature avoids storing the evaporated fuel in a state of liquid within the surge tank.

DETAILED DESCRIPTION

An embodiment of the present invention will now be described in detail with reference to FIGS. 1 to 5.

Figure 5:
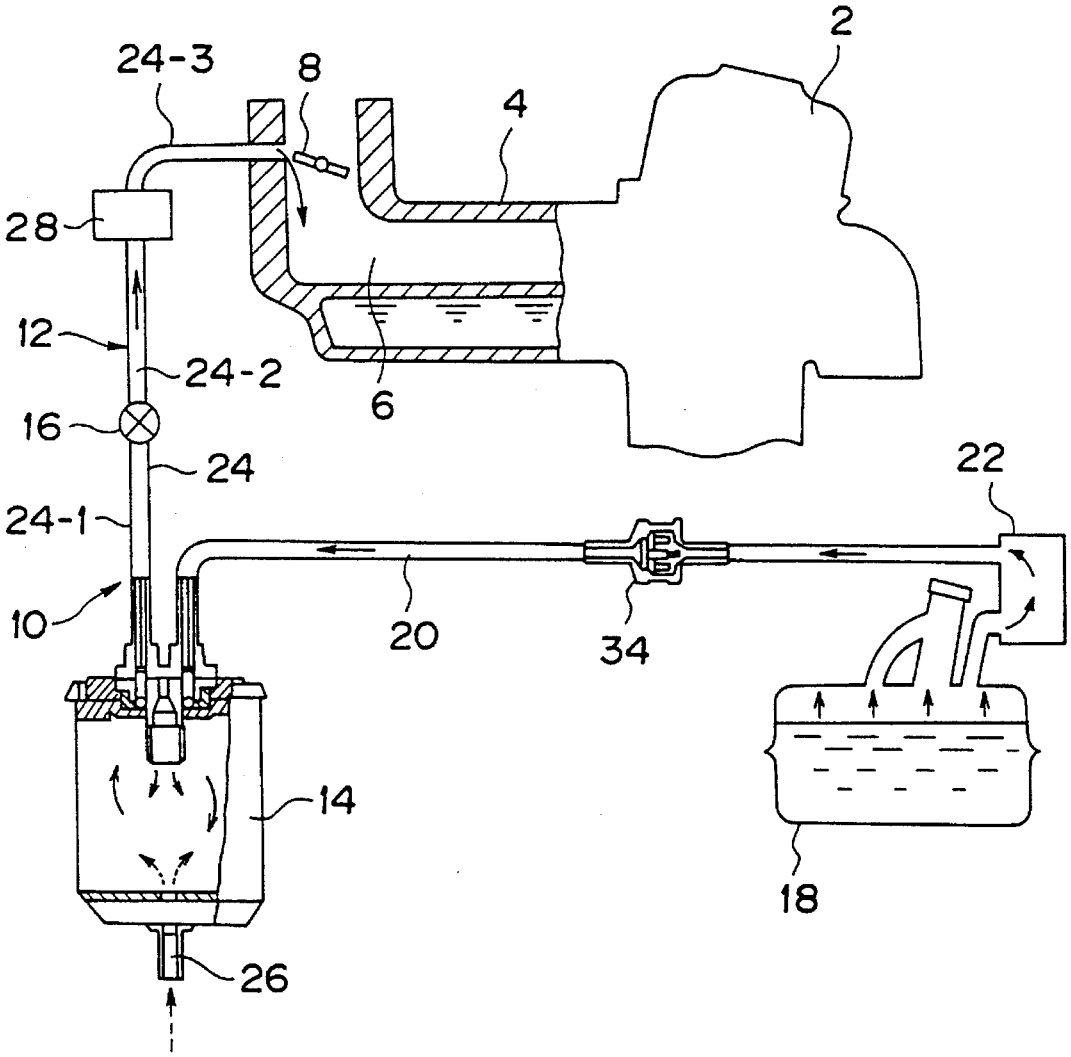

In FIG. 5, reference numeral 2 denotes a combustion engine which is disposed in a vehicle (not shown); 4 an intake manifold; 6 an air intake passage; 8 a throttle valve; and 10 an evaporative fuel discharge-preventing device.

The device 10 has an air communication passage 12, a canister 14, and a purge valve (VSV) 16.

The air communication passage 12 intercommunicates the inside of a fuel tank 18 and the air intake passage 6 in the intake manifold 4 of the engine 2. An evaporation passage 20, which forms a part of the air communication passage 12, communicates at one end with the inside of an evaporative fuel storage portion 22 of the fuel tank 18. The other end of the evaporation passage 20 opens to the upper inside of the canister 14.

In addition, a purge passage 24, which forms a part of the air communication passage 12, opens at one end to the upper inside of the canister 14 in a manner similar to the evaporation passage 20. The other end of the purge passage 24 communicates with the air intake passage 6 on a downstream side of the throttle valve 8.

The canister 14 contains an absorbent (not shown), such as activated carbon, for absorbing and retaining evaporated fuel from the fuel tank 20. The fuel absorbingly carried on the absorbent is released (purged) therefrom by fresh outside air being introduced into the canister 14 through an ambient air introduction port 26 at a lower portion of the canister 14 in accordance with a running state of the engine 2. The released (purged) fuel is then forced to flow toward the purge passage 24. More specifically, the evaporated fuel, which is generated in the fuel tank 18, is absorbed and maintained by the canister 14 during stopping of the engine 2. The absorbingly maintained fuel is liberated from the canister 14 during operation of the engine 2 by fresh air being introduced into the canister 14. The evaporated fuel is thereby supplied to the air intake passage 6.

The purge valve 16 is provided midway along the purge passage 24. The purge passage 24 is thereby divided into a first purge passage part 24-1 on the side of the canister 14 and a second purge passage part 24-2 on the side of the air intake passage 6. The purge valve 16 communicates and discommunicates the first and second purge passages parts 24-1 and 24-2.

When the relationship between engine rotational speed and negative pressure in an air intake pipe lies in a predetermined range, the purge valve 16 is driven into "on" action by means of a control means (not shown) which inputs an operating state of the engine 2 on the basis of, e.g., an air quantity and the like.

Further, a surge tank 28 is placed midway of the air communication passage 12 between the intake manifold 4 and the purge valve 16. The surge tank 28 has a predetermined volumetric capacity, and is situated at a position greater in height than the intake manifold 4.

In greater detail, the surge tank 28 is disposed midway along the second purge passage part 24-2. The second purge passage part 24-2 is thereby sub-divided into a second purge passage portion 24-2 on the side of the purge valve 16 and a third purge passage portion 24-3 on the side of the air intake passage 6.

The capacity of the surge tank 28 is established at, e.g., 50 $cm^3$ or greater. In addition, as shown in FIG. 1, there is a difference H in height between an upper surface of the intake manifold 4 and the center of an outlet side pipe 30 of the surge tank 28; this distance H being greater than zero.

Figure 2:
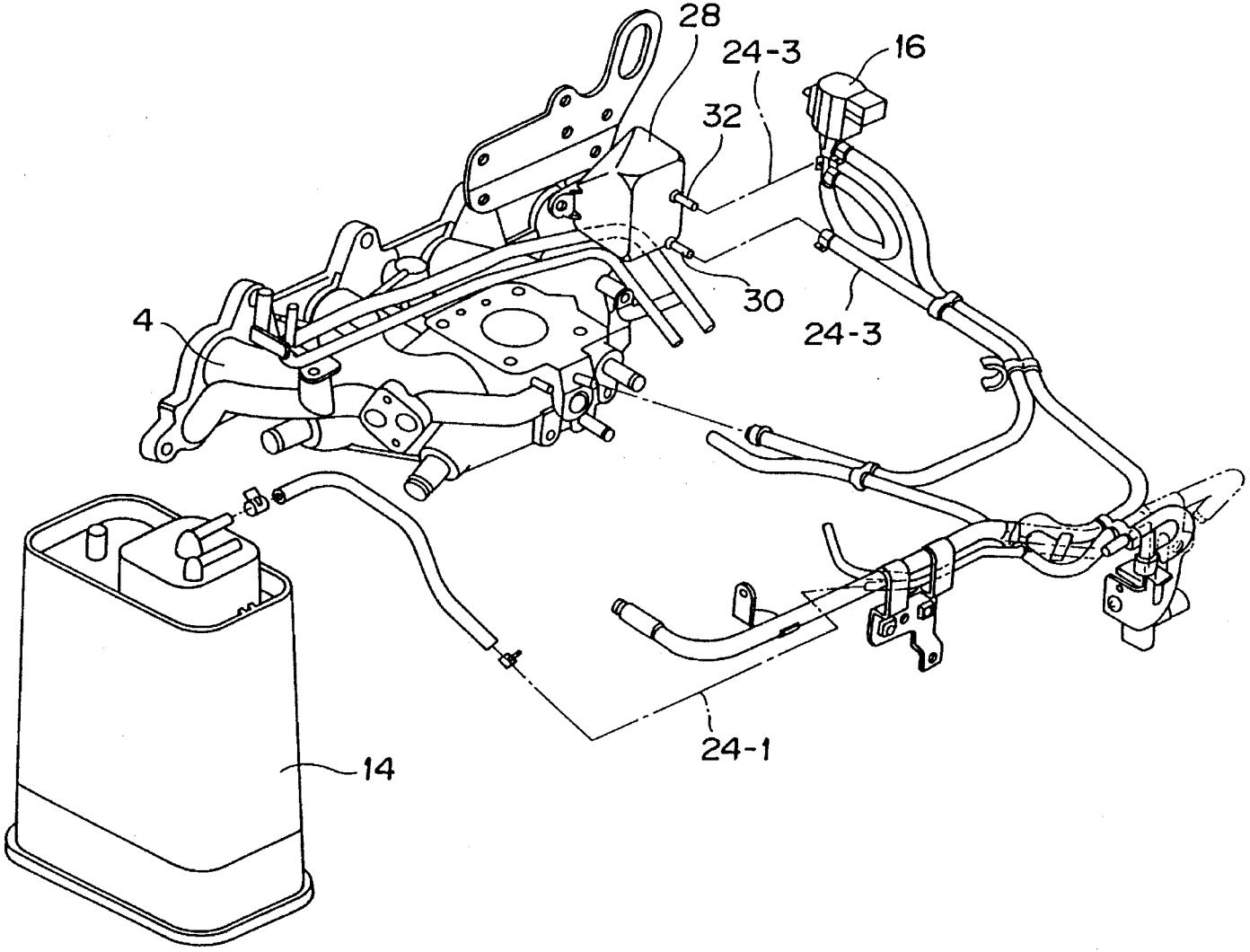
FIG. 2 is a schematic perspective view illustrating an assembled state of an evaporative fuel discharge-preventing device for an engine.

Turning now to FIG. 2, the surge tank 28 is shown fixed to a cylinder head (not shown) of the engine 2 through an unillustrated bracket and the intake manifold 4.

Further, the surge tank 28 has the outlet side pipe 30 positioned at a lower portion thereof and an inlet side pipe 32 located at a position above the outlet side pipe 30.

Figure 1:
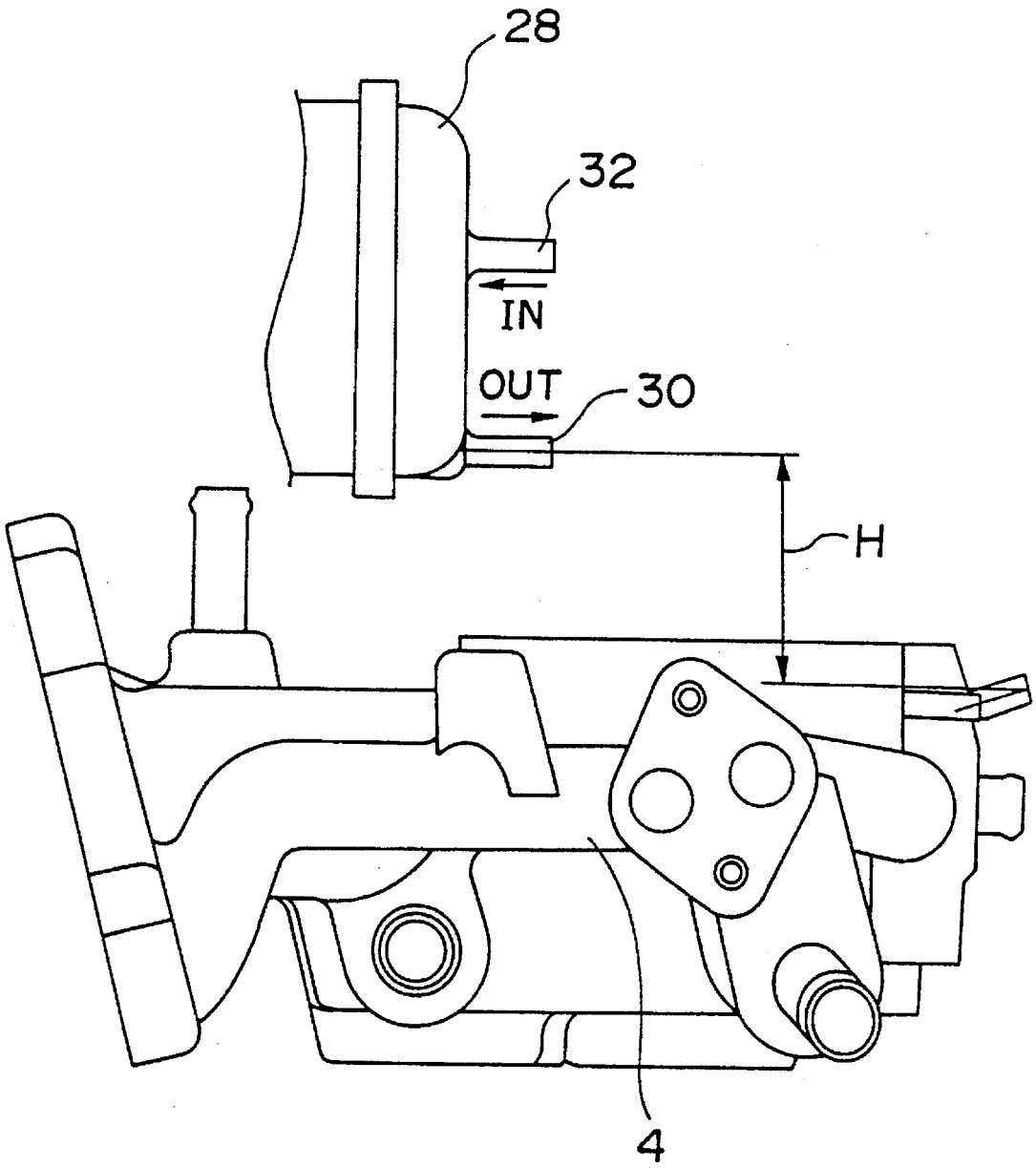
FIG. 1 is an enlarged view illustrating essential portions of an engine intake manifold and a surge tank, which incorporates an embodiment of the present invention.
Figure 3:
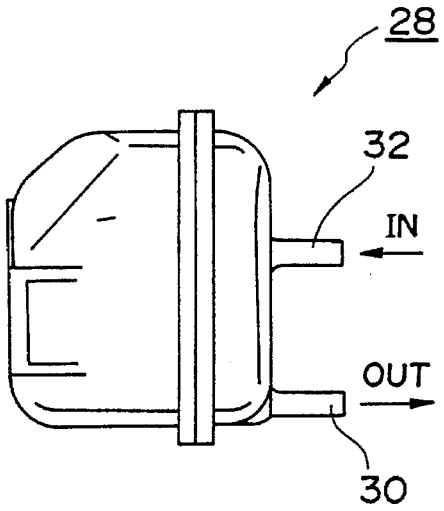
FIG. 3 is a front view showing the surge tank.
Figure 4:
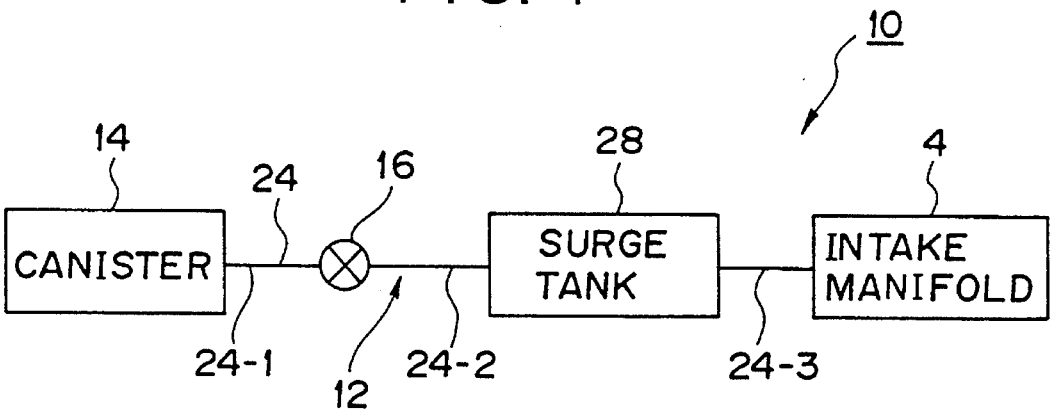
FIG. 4 is a schematic block view showing the evaporative fuel discharge-preventing device; and, FIG. 5 is a schematic view depicting the evaporative fuel discharge-preventing device.

In further detail, as illustrated in FIGS. 1 and 3, when the surge tank 28 is provided with the outlet and inlet side pipes 30 and 32, the outlet side pipe 30 is situated at a lower position of the surge tank 28, i.e., at a position capable of avoiding evaporative fuel from residing in a state of liquid within the surge tank 28. Further, the inlet side pipe 32 is located at a position above the outlet side pipe 30 by a predetermined height.

Reference numeral 34 (FIG. 5) denotes a check valve which is positioned midway along the evaporation passage 20 for allowing flow from the fuel tank 18 toward the canister 14.

Next, the operation of the present invention will be described.

While the engine 2 remains stopped, evaporative fuel which is generated in fuel tank 18 is drawn into canister 14 from evaporative fuel storage portion 22 through evaporation passage 20 so as to be absorbingly retained by the canister 14.

While the engine 2 is running, purge valve 16 is brought into on-action so as to be opened. The opened purge valve 16 introduces fresh outside air into the canister 14 through ambient air introduction port 26. The absorbingly retained, evaporative fuel is thereby liberated from the canister 14. The liberated fuel is then supplied toward the air intake passage 6.

At this time, in order to avoid storing the evaporated fuel in a liquid state at the lower inside of the surge tank 28, the evaporative fuel supplied from the canister 14 is caused to flow into the surge tank 28 through the inlet side pipe 32, and to flow out of the surge tank 28 through the outlet side pipe 30 toward the air intake passage 6.

The surge tank 28 is thereby allowed to smooth out or equalize fluctuations in the amount of the evaporated fuel to be inducted from the canister 14 into the engine 2, or rather variations in a purge flow amount due to pulsation. As a result, a stabilized engine rotational speed is achievable, which can consequently prevent the impairment of drivability. In particular, since a single point injection (SPI) type engine is susceptible to greater or smaller variations in the purge flow amount, the aforesaid arrangement of the surge tank is possible to stabilize air-fuel ratio control.

In addition, since the surge tank 28 is located at a position greater in height than the intake manifold 4, the evaporated fuel is smoothly admitted from the higher position, i.e., the surge tank 28, into the engine 2. As a result, there is no likelihood that the evaporated fuel stays in a liquid state midway along the air communication passage 12. This is advantageous in view of practical use.

Furthermore, since the volumetric capacity of the surge tank 28 is established at, e.g., 50 $cm^3$ or larger, a minimum capacity of the surge tank 28 can be established, thereby deciding a minimum level required to level out fluctuations in the amount of the evaporated fuel. As a result, it is possible to achieve an expected value for stabilizing engine rotational speed and for preventing aggravation of drivability.

Moreover, since the surge tank 28 has the inlet side pipe 32 situated at a position above the outlet side pipe 30, coagulated evaporative fuel smoothly flows through the inside of the surge tank 28 as a result of the outlet side and inlet side pipes 30 and 32 being arranged at such a height position. This feature eliminates the possibility that the evaporated fuel resides in a liquid state within the surge tank. As a result, it is possible to enhance convenience of use.

As amplified in the above description, according to the present invention, the surge tank, which has a predetermined volumetric capacity and is located at a height position greater than the intake manifold, is placed midway along the air communication passage between the engine intake manifold and the purge valve. This arrangement allows the surge tank to level out fluctuations in the amount of evaporative fuel which is admitted from the canister into the engine. As a result, it is possible to stabilize an engine rotational speed, and to prevent degradation in drivability. In addition, since the surge tank is located at a position greater in height than the intake manifold, the evaporative fuel is smoothly inducted from the greater height position, e.e., the surge tank, into the engine. As a result, there is no likelihood of the evaporative fuel being lodged in a liquid state midway along the air communication passage. This is advantageous in view of practical use. Furthermore, since a volumetric capacity of the surge tank is established at, e.g., 50 $cm^3$ or greater, a minimum capacity of the surge tank can be established, thereby determining a minimum level required to reduce fluctuations in the amount of the evaporative fuel. As a result, it is possible to grasp an expected value for stabilizing engine rotational speed and for preventing aggravation of drivability.

The embodiments of the invention in which an exclusive property or privilege is claimed are defined as follows:

1. In an evaporative fuel discharge-preventing device for an engine, having a canister provided midway along an air communication passage which intercommunicates the inside of a fuel tank and an air intake passage of an engine intake manifold, and a purge valve provided in said air communication passage between said canister and said intake manifold, in which said canister absorbingly retains evaporated fuel during stopping of said engine, said evaporated fuel being generated in said fuel tank, but releases said absorbingly retained fuel from said canister during operation of said engine by fresh air being introduced into said canister, whereby said evaporated fuel is supplied to said air intake passage, the improvement comprising: a surge tank, having a predetermined volumetric capacity, disposed in said air communication passage between said intake manifold and said purge valve, said surge tank being located at a position greater in height than said intake manifold and said surge tank having an outlet side pipe positioned at a lower portion thereof and an inlet side pipe located at a position above said outlet side pipe.

* * * * *